United States Patent [19]

Walton

[11] Patent Number: 4,726,608

[45] Date of Patent: Feb. 23, 1988

[54] INFORMATION BEARING ARTICLE WITH TAMPER RESISTANT SCRATCH-OFF OPAQUE COATING

[75] Inventor: Bradley W. Walton, San Jose, Calif.

[73] Assignee: Scientific Games of California, Inc., Gilroy, Calif.

[21] Appl. No.: 893,576

[22] Filed: Aug. 5, 1986

[51] Int. Cl.[4] ..... B42D 15/00

[52] U.S. Cl. ..... 283/96; 283/102; 283/901; 283/903

[58] Field of Search ..... 283/94, 95, 96, 97, 283/102, 901, 903

[56] References Cited

U.S. PATENT DOCUMENTS 4,095,824 6/1978 Bachman .
4,120,445 10/1978 Carrier et al. .
4,241,942 12/1980 Bachman .
4,273,362 6/1981 Carrier et al. .
4,398,708 8/1983 Goldman et al. .
4,407,443 10/1983 McCorkle .
4,457,430 7/1984 Darling et al. .
4,488,646 12/1984 McCorkle .
4,536,218 8/1985 Ganho .

FOREIGN PATENT DOCUMENTS 2060491 5/1981 United Kingdom ..... 283/96

*Primary Examiner*—Paul A. Bell
*Attorney, Agent, or Firm*—Jenner & Block

[57] ABSTRACT

An indicia bearing article, such as a lottery ticket, contest form or other document, for example, is provided. The article includes an indicia bearing sheet and an opaque coating thereover for hiding the indicia. The opaque coating contains metal particles and at least one undissolved dye soluble in at least one solvent and dispersed in the opaque coating and hidden beneath the metal particles, for providing visual evidence of exposure to the solvent.

30 Claims, 2 Drawing Figures

INFORMATION BEARING ARTICLE WITH TAMPER RESISTANT SCRATCH-OFF OPAQUE COATING

FIELD OF THE INVENTION

The invention relates to an information-bearing article such as a document, lottery ticket, contest form and the like, where hidden indicia must remain undetected for security and for effective utilization thereof by the intended person. More particularly, the present invention relates to an information-bearing article that includes an indicator to various types of tampering that could be used in an effort to detect hidden indicia or tampering that has occurred.

BACKGROUND OF THE INVENTION

Recently, the preparation and distribution of promotional game cards, premium cards, lottery tickets and the like, containing hidden messages or symbols has become popular and widespread, in fundraising and product promotion. The recipient or user of such a card must remove from the card a layer of opaque coating material in order to reveal a number, message or symbol. A check number or security number may also be included on the document or ticket.

It would be desirable, for security reasons, to provide an article having hidden indicia that would provide an indication of whether the article has been exposed to various types of tampering or materials that potentially may be used for tampering in an effort to detect the hidden indicia or alter the article.

Modern technology gives the unauthorized person a number of techniques with which he may attempt an unauthorized detection of the hidden indicia or alteration of the article. A need exists to indicate tampering of the article from exposure to various solvents, glues, and elevated temperature.

SUMMARY OF THE INVENTION

In accordance with the present invention, an indicia bearing article is provided of the type having hidden indicia not readily detectable except by irreversible alteration of the article. The article includes an indicia bearing surface and an abrasive removable or scratch-off opaque coating over at least a portion of the indicia, thereby making the covered indicia hidden. The opaque coating often contains a binder, usually comprising a resin. Latex resin is preferred and a latex resin soluble in hydrocarbon solvents is especially preferred. The opaque coating includes at least one undissolved dye, soluble in at least one solvent, that is dispersed in the opaque coating and visually hidden under metal particles over the dye. Preferably the metal particles are located at the surface of the opaque coating.

The dye or dyes in the opaque coating can provide a visual indication of exposure to the solvent. Usually, the dye or dyes will be chosen for solubility in solvents for which protection from tampering or for which a visual indication of exposure to a particular solvent is desired.

Because the dye is hidden by the metall particles in the opaque coating, the opaque coating gives no visual indication of containing dye. This allows the use of much stronger and more vividly colored dyes, and at relatively high concentration in the opaque coating, thereby providing a more positive indication of exposure to solvents and preventing undetected chemical tampering.

In accordance with another aspect of the invention, an opaque coating is provided that is applied to an article for hiding desired indicia and for providing a visual indication of exposure to at least one solvent. The coating includes at least one undissolved dye, soluble in at least one solvent and dispersed in the opaque coating and visually hidden under metal particles over said dye and preferably located at the surface of the opaque coating.

As used herein, the term "indicia" is used in a broad sense and means any symbol, number, letter, or any combinations thereof, that can be applied in some manner, such as by any type of printing, writing, lithographing, silk-screening, or some other process, to a surface. Usually, the surface will be the surface of a substrate or a sheet of material, which may have thereon a coating or coatings.

DETAILED DESCRIPTION OF THE INVENTION

Figure 1:
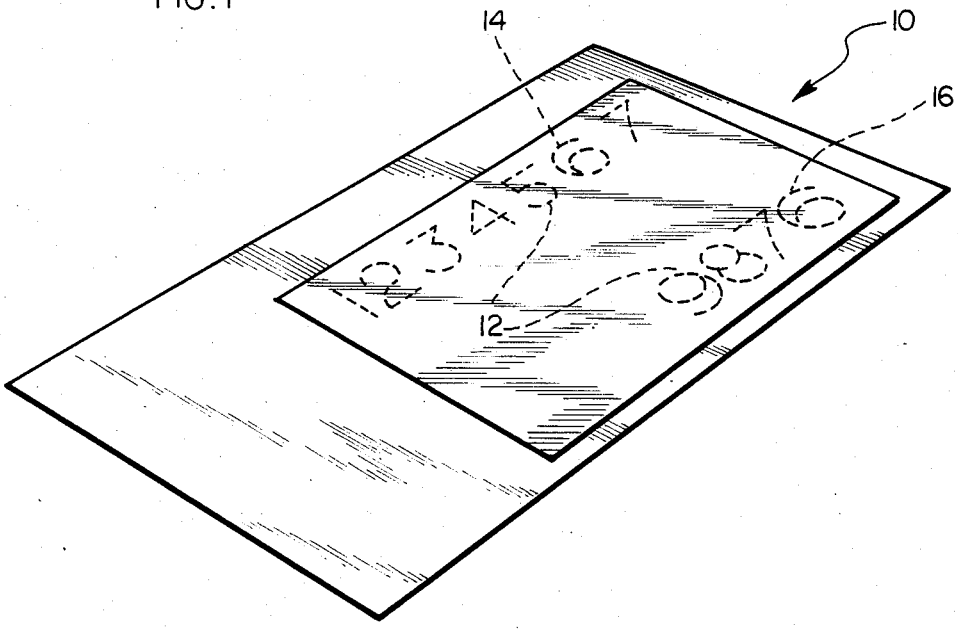
FIG. 1 is a perspective view of a lottery ticket in accordance with the invention.
Figure 2:
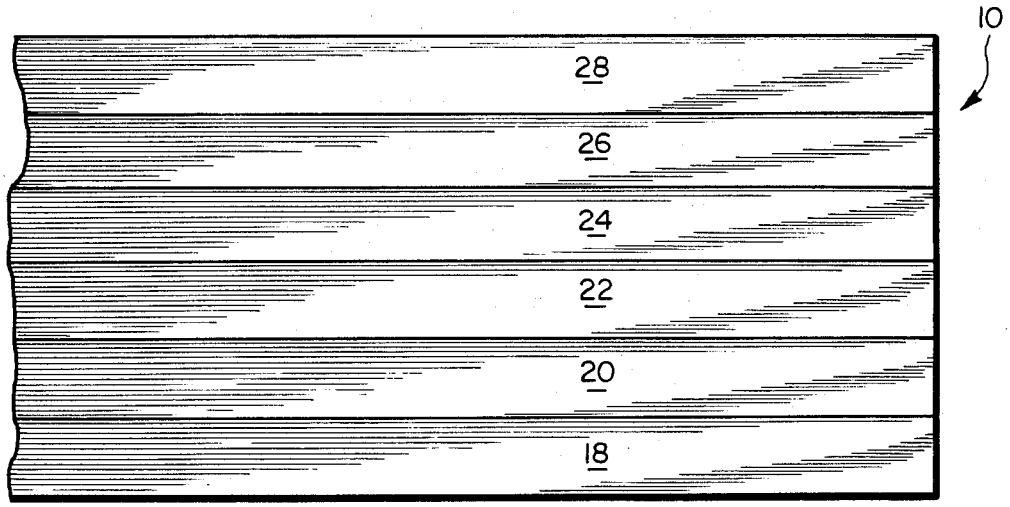
FIG. 2 is a schematic fragmentary elevation view of the lottery ticket of FIG. 1.

Referring to the drawings generally, there is illustrated an instant lottery ticket 10. Lottery ticket 10 includes hidden indicia 12, which, in this case, includes a lottery playing number 14 and a validity number 16. Other information, such as the lottery name and instructions (not shown) may also be included on a typical lottery ticket.

In the illustrated embodiment, lottery ticket 10 is composed of different layers of materials. These layer include a substrate 18, a foil layer 20, a primer coating 22, an indicia image 24, a seal coating 25, a release coating 26 and an abrasive removable or scratch-off opaque seal coating 28. As will be appreciated by one skilled in the art, the present invention is applicable to may varieties of documents, lottery tickets, contest forms and the like. It is intended that the specific lottery ticket embodiment disclosed in the drawing represents merely one suitable construction that may be utilized.

Substrate 18 is of a suitable material which generally will be paper or cardboard. Foil layer 20, which in this case is aluminum foil, is adhered to substrate 18, usually by means of a suitable adhesive.

Primer coating 22 is applied over foil layer 20 where necessary or desired to provide a suitable surface for allowing printing of a desired image. A preferred primer coating 22 includes, on a percent by weight basis, about 6% amorphous silica (Syloid 244 from Davidson Chemical Corp.), about 22.5% of VMCA (a maleic acid copolymer of vinyl acetate) from Union Carbide and the remainder being a solvent, such as n-propylacetate.

The image in this embodiment is ink jet indicia image 24, which is printed by ink jet printing, a method well known in the art. An especially suitable ink is a water based, water soluble ink. Other methods of printing or applying image 24 and inks can be used, of course, as desired.

Seal coating 25 protects image 24 from liquids in which the ink is soluble, such as water, for example. Suitable material for this purpose include polymer materials, such as acrylics, polyester urethanes, epoxy acrylates and vinyl polymer. VMCA is an especially suitable material for seal coating 25, which may also include dioctylphthalae. An especially suitable composition contains by weight, 22.5% VMAC, 5% dioctylphthalate, 0.125% yellow dye (Macrolex 6G Dye) and the balance solvent, such as n-propylacetate.

Release coating 26 is applied over seal coating 25, to facilitate abrasive removal of opaque coating 28. Release coating 26 provides a non-binding interface for opaque coating 28. Any type of release coating that provides the desired effects can be utilized. Generally, the release coating will include a resin material, a metallic soap and preferably also includes the antistatic material when present. An especially suitable release coating contains, on a wet weight basis (prior to application), 20% polyamide resin (Henkel 940 resin), 30% ethanol, 25% lacquer diluent (aliphatic hydrocarbon solvent), 25% zinc stearate, and 0.01% UV brightener Unitex OB.

Opaque seal coating 28 can be of any suitable type for the purpose of blocking the desired portion or portions of indicia image 24 from view and accommodating the desired dye or dyes. Opaque seal coating 28 contains indicator dyes that are visually hidden and dispersed with coating 28, beneath metal particles. Preferably, each of the following or similar dyes are utilized: Ceres Yellow, Basonyl Yellow 120 ("Basonyl" is a trademark of BASF, Inc.) and tartrazine yellow. Ceres Yellow is soluble in aromatic and hydrocarbon solvents. Basonyl Yellow 120 is soluble in alcohols and spirit solvents. Tartrazine Yellow is soluble in water. The opaque coating is applied as a liquid dispersion. Preferably the concentration of each of the dyes is from about 1 to 2% by weight of the liquid dispersion. The foregoing combination of dyes also provides sufficient sublimation when exposed at a temperature of about 260° F. to provide a visual indication. Preferably, opaque seal coating 28 is a latex resin based coating. A suitable latex that contains powdered aluminun and is known as a silver scratch-off printing ink No. 590597 from Colonial Print Ink Corp. of East Rutherford, N.J. This latex is soluble in hydrocarbon solvents.

A preferred latex composition for the scratch-off coating contains, prior to application, the following components and amounts by weight percent of the composition: Shell Kraton 1107 (rubber resin), 11.84%; Reichold Chemical Co. Nirez 2040 (hydrocarbon resin), 2.20%; Georgia Marble Co. G-S80 (calcium carbonate), 26.30%; Reynolds Aluminum Co. ink grade aluminum powder, 16.66%; toluene, 7.76%; printing ink lacquer diluent, 30.76%; Ethyl Corp. Ethyl 330 (antioxidant), 0.1%; Printex 35 carbon black from Carmona Corp., 4.38%. Preferably, a portion (for example, about 25% of the total) of the Kraton, Nirez, toluene and lacquer diluent is mixed together with the carbon black and put through a shot mill to obtain a good dispersion. The materials are conveniently mixed together in the following order: (1) mixing the balance of the Nirez with the balance of the toluene; and thereafter adding and mixing (2) the balance of the lacquer diluent; (3) the balance of the Kraton; (4) the calcium carbonate; (5) the aluminum powder; and (6) the carbon black, Kraton, Nirez, toluene and lacquer diluent mixture.

Preferably, the various materials present in lottery ticket 10 applied with a liquid carrier or solvent are applied by a rotogravure process, the carrier or solvent preferably being sufficiently volatile to permit rapid production.

Generally, the opaque seal coating, which contains metal particles, will be of the type where the phenomenon known as "leafing" occurs as the seal coating dries after application. "Leafing" causes metal particles at the surface to be oriented so that the sides of the particles are substantially parallel to the surface, thereby forming a cover layer for the materials beneath. Preferably, an ink grade metal powder is utilized, such as ink grade aluminum powder.

While the invention has been described in relation to its preferred embodiments, it is to be understood that various modifications thereof will be apparent to those of ordinary skill in the art upon reading this specification and it is intended to cover all such modifications as fall within the scope of the appended claims.

I claim:

1. An opaque abrasive removable coating applied to an article of the type including an indicia bearing surface, for providing a visual indication of exposure to at least one solvent, said opaque coating comprising a binder having metal particles and at least one undissolved dye soluble in at least one solvent and dispersed in said binder and hidden beneath said metal particles, for providing visual evidence of exposure to said solvent.

2. The coating of claim 1 wherein said metal particles comprise aluminum.

3. The coating of claim 1 wherein said metal particles comprise ink grade aluminum powder.

4. The coating of claim 1 wherein said metal particles are at the surface of said opaque coating.

5. The coating of claim 1 wherein said binder is latex resin.

6. The coating of claim 5 wherein said latex resin is soluble in hydrocarbon solvents.

7. The coating of claim 5 wherein said latex resin is soluble in water.

8. The coating of claim 7 wherein said dye is soluble in oil.

9. The coating of claim 1 wherein said dye is soluble in hydrocarbon solvents.

10. The coating of claim 1 wherein said dye is soluble in aliphatic hydrocarbon solvents.

11. The coating of claim 1 wherein said dye is soluble in aromatic solvents.

12. The coating of claim 1 wherein said dye is soluble in water.

13. The coating of claim 1 wherein said at least one dye comprises a water soluble dye, a hydrocarbon soluble dye and an alcohol soluble dye.

14. The coating of claim 1 wherein said dye sublimates sufficiently to produce a visual indication of said dye when exposed to a temperature of about 260° F. when in said opaque coating.

15. The coating of claim 1 wherein said at least one dye is soluble in water, mineral spirits and aromatic solvents.

16. An indicia bearing article of the type having hidden indicia not readily detectable except by irreversible alteration of said article, said article comprising:

an indicia bearing surface;

an opaque abrasive removable coating over at least a portion of said indicia for hiding said indicia, said opaque coating comprising a binder containing metal particles and at least one undissolved dye soluble in at least one solvent and dispersed in said binder and hidden beneath said metal particles, for providing visual evidence of exposure to said solvent.

17. The article of claim 16 wherein said metal particles comprise aluminum.

18. The article of claim 16 wherein said metal particles comprise ink grade aluminum powder.

19. The article of claim 16 wherein said metal particles are at the surface of said opaque coating.

20. The article of claim 16 wherein said binder is latex resin.

21. The article of claim 20 wherein said latex resin is soluble in hydrocarbon solvents.

22. The article of claim 20 wherein said latex resin is soluble in water.

23. The article of claim 22 wherein said dye is soluble in oil.

24. The article of claim 16 wherein said dye is soluble in hydrocarbon solvents.

25. The article of claim 16 wherein said dye is soluble in aliphatic hydrocarbon solvents.

26. The article of claim 16 wherein said dye is soluble in aromatic solvents.

27. The article of claim 16 wherein said dye is soluble in water.

28. The article of claim 16 wherein said at least one dye comprises a water soluble dye, a hydrocarbon soluble dye and an alcohol soluble dye.

29. The article of claim 16 wherein said dye sublimates sufficiently to produce a visual indication of said dye when exposed to a temperature of about 260° F. when in said opaque coating.

30. The article of claim 16 wherein said at least one dye is soluble in water, mineral spirits and aromatic solvents.

* * * * *